US007117802B2

(12) United States Patent
Hoke, Jr. et al.

(10) Patent No.: US 7,117,802 B2
(45) Date of Patent: Oct. 10, 2006

(54) CUBICLE SHIELD

(76) Inventors: Gary Dale Hoke, Jr., 5523 Southern Cross Ave., Raleigh, NC (US) 27606; Paul Rony, 705 Laurel Bay La., Holly Springs, NC (US) 27540

( * ) Notice: Subject to any disclaimer, the term of this patent is extended or adjusted under 35 U.S.C. 154(b) by 0 days.

(21) Appl. No.: 10/236,118

(22) Filed: Sep. 6, 2002

(65) Prior Publication Data

US 2003/0140823 A1 Jul. 31, 2003

(51) Int. Cl.
*A47B 57/00* (2006.01)

(52) U.S. Cl. ..... 108/60

(58) Field of Classification Search ..... 108/60, 108/59, 61; 211/184; 135/87, 115, 119, 135/143

See application file for complete search history.

(56) References Cited

U.S. PATENT DOCUMENTS

| | | | | | |
|---|---|---|---|---|---|
| 1,810,618 | A | * | 6/1931 | Nelson | 108/60 |
| 2,908,400 | A | * | 10/1959 | Richter | 108/60 |
| 2,942,924 | A | * | 6/1960 | Stangert | 108/60 |
| 3,389,947 | A | * | 6/1968 | Kelley et al. | 108/60 |
| 3,538,976 | A | * | 11/1970 | Gilbert | 108/60 |
| 3,698,104 | A | * | 10/1972 | Sutton | 108/60 |
| 3,716,446 | A | | 2/1973 | Dean | |
| 4,484,787 | A | * | 11/1984 | Stephens | 108/60 |
| 4,715,154 | A | | 12/1987 | Baloga | |
| 4,986,194 | A | * | 1/1991 | Bollman | 108/60 |
| 5,159,883 | A | * | 11/1992 | Rosenberg | 100/115 |
| 5,188,232 | A | * | 2/1993 | Carver | 206/434 |
| 5,406,893 | A | * | 4/1995 | Burns | 108/60 |
| 5,471,800 | A | * | 12/1995 | Hill et al. | 108/60 |
| D399,063 | S | | 10/1998 | Verbeek et al. | |
| 5,823,212 | A | * | 10/1998 | Allen | 135/16 |
| 6,024,264 | A | * | 2/2000 | Java | 135/16 |
| 6,247,482 | B1 | * | 6/2001 | Muis | 135/16 |
| 6,253,826 | B1 | | 7/2001 | Witter et al. | |
| 6,354,043 | B1 | | 3/2002 | Simon et al. | |

FOREIGN PATENT DOCUMENTS

| | | | |
|---|---|---|---|
| JP | 149190 | * | 6/2001 |

* cited by examiner

*Primary Examiner*—Jose V. Chen

(57) ABSTRACT

A shield for a cubicle including an at least partially opaque covering suspended over the cubicle such that the environmental parameters are attenuated, and a frame for supporting the at least partially opaque covering, thereby providing protection for the cubicle user against environmental parameters. Alternatively, a frameless shield may be provided.

1 Claim, 8 Drawing Sheets

CUBICLE SHIELD

BACKGROUND OF THE INVENTION (1). Field of the Invention

The present invention relates generally to office furniture and, more particularly, to a cubicle shield for providing shielding from lighting and ventilation.

(2). Description of the Prior Art

Cubicles have no ceilings and as such do not provide any controls to allow cubicle occupants or users to regulate and/or adjust light and/or ventilation within the cubicle. Some personnel using cubicles would like to reduce the light and/or ventilation reaching them. No prior art is directed to a movable, positionable overhead cubicle shield able to block light and/or ventilation. Thus, a need exists for a moveable, positionable overhead cubicle shield that can attenuate environmental parameters such as light and ventilation.

SUMMARY OF THE INVENTION

The present invention is directed to a shield for sheltering a cubicle inhabitant from environmental parameters, such as lighting or ventilation, by attenuating the environmental parameters. Additionally, the cubicle shield can be used as a support for images or designs.

Preferably, the present invention consists of a cubicle-mountable covering with or without a frame.

Accordingly, one aspect of the present invention is to provide a shield for sheltering a cubicle inhabitant from environmental parameters including an at least partially opaque covering suspended over the cubicle such that the environmental parameters are attenuated, and a frame for supporting the at least partially opaque covering, thereby providing protection for the cubicle inhabitant against environmental parameters.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
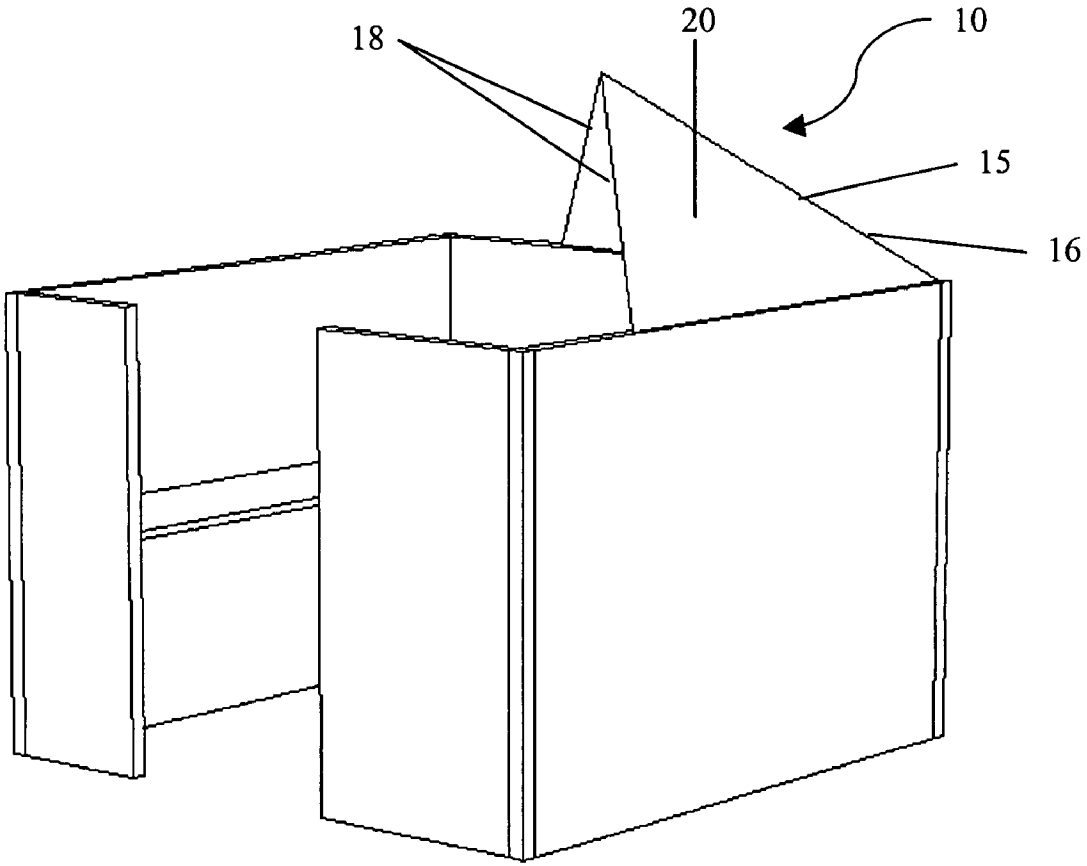
FIG. 1 is a perspective view of a preferred embodiment according to the present invention and mounted on a cubicle.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Figure 2:
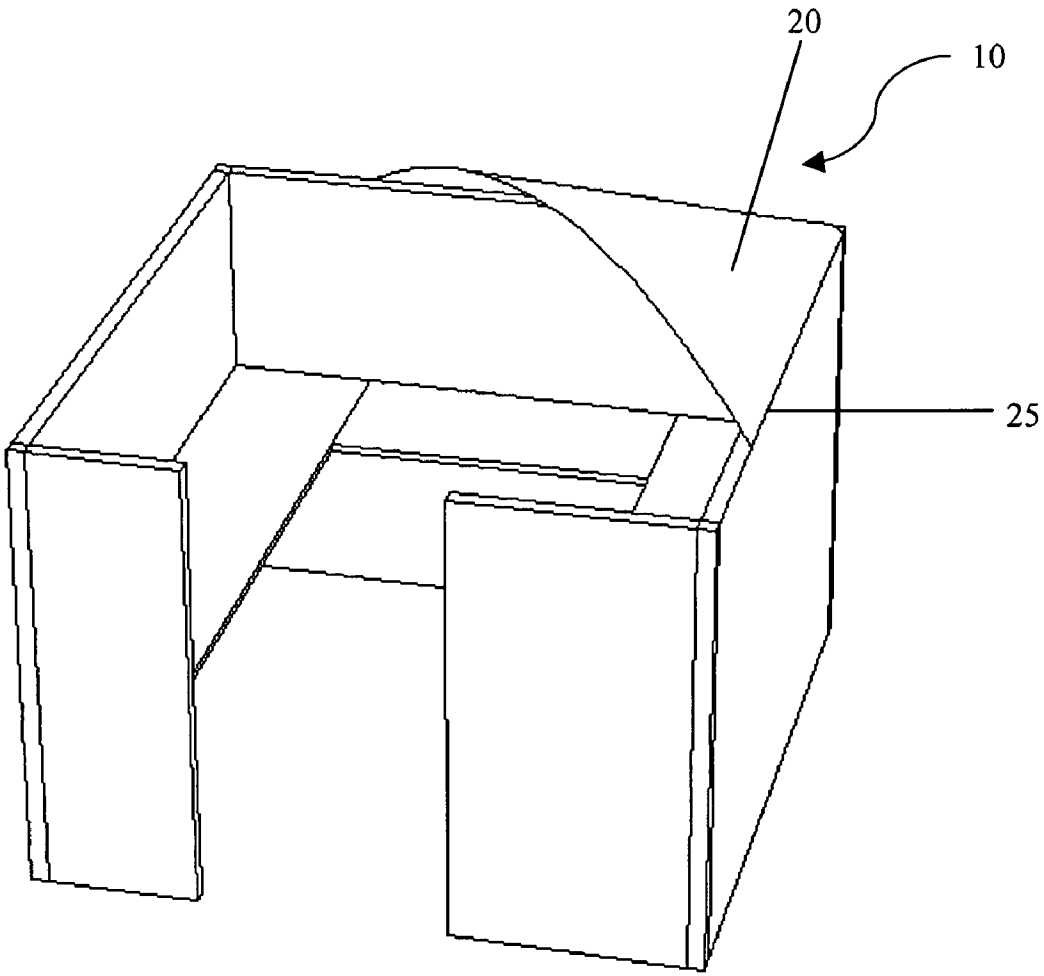
FIG. 2 is a perspective view of another embodiment of a cubicle shield constructed according to the present invention.
Figure 3:
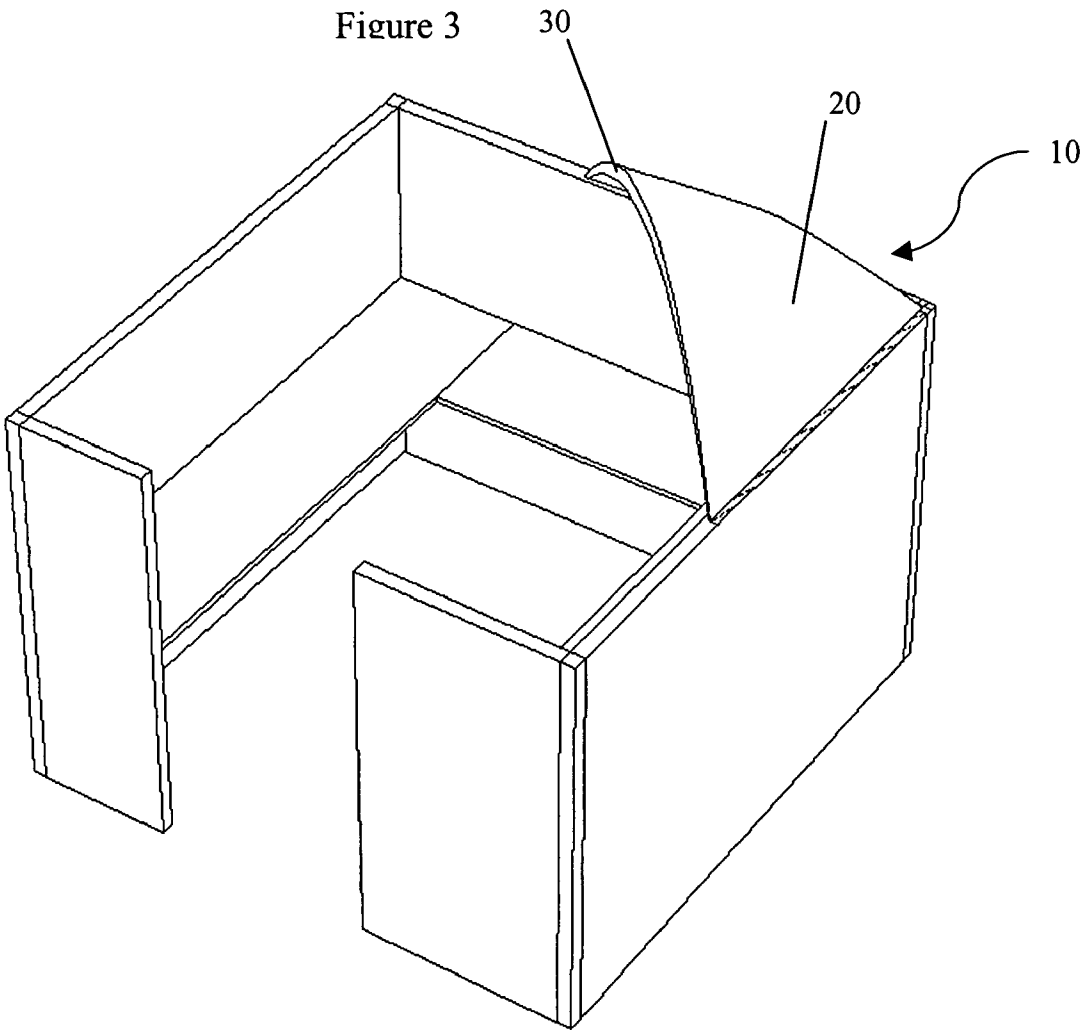
FIG. 3 is a perspective view of still another embodiment of a cubicle shield constructed according to the present invention.

Referring now to the drawings in general, the illustrations are for the purpose of describing a preferred embodiment of the invention and are not intended to limit the invention thereto. As best seen in FIG. 1, the shield, generally referred to as 10, consists of a frame 15 and a covering 20. These two components, namely the frame and covering, are preferably formed from separate elements in a preferred embodiment of the present invention, as shown in FIG. 1. In an alternative embodiment of the present invention, the frame is provided and formed by the cubicle walls 25, as shown in FIG. 2. Alternatively, the cubicle shield is made using rigid materials that integrate both frame and covering components into a unitary, integral construction that requires only vertical support, as shown in FIG. 3, which represents yet another embodiment of the present invention. In the embodiment illustrated in FIG. 3, the thickness of the canopy material 30 is such that the rigidity of the canopy is adequate to make it self-supporting; the thickness required for the cubicle shield canopy to be self-supporting is dependent upon the type of canopy material selected and the properties of that material. In that embodiment, the integral, self-supporting cubicle shield, generally described as 10 in FIG. 3, is formed of a rigid material that is pre-molded to the desired shape, making it self-supporting. This embodiment rests directly on the cubicle walls as illustrated. It may be additionally secured or fastened to the cubicle walls using fasteners, including but not limited to hook-and-loop fasteners, pins, clips, screws, and adhesives; note that this securement is not a requirement but advantageously provides additional securement in the event of impact to the cubicle structure or other vibration that might otherwise occur and potentially affect the original positioning of the shield resting on the cubicle itself.

In general, the present invention advantageously and usefully supplies diagonal screening or shadowing, i.e., preferably the shield is positioned with respect to the overhead light and the cubicle such that a shadow cast by the shield is at least as large or larger than the cross-sectional area of the shield and projects diagonally across the cubicle space, rather than projecting directly down or onto a smaller area or region. The shadowing effect provides a controllable effect on overhead lighting in order to provide individualized shading, which can be advantageous for preventing or reducing glare on a computer screen within the cubicle workspace as well as provide lower lighting within a cubicle space to a user who otherwise cannot dim or reduce the overhead lighting within an office environment without affecting other workers. Notably, where a group of cubicle users prefer shading or shadowing as provided by the present invention, a cubicle shield embodiment according to the present invention that provides coverage over a multiplicity of cubicles may be employed; otherwise, a cubicle shield embodiment that provides coverage over a single cubicle work space may be employed.

Figure 5:
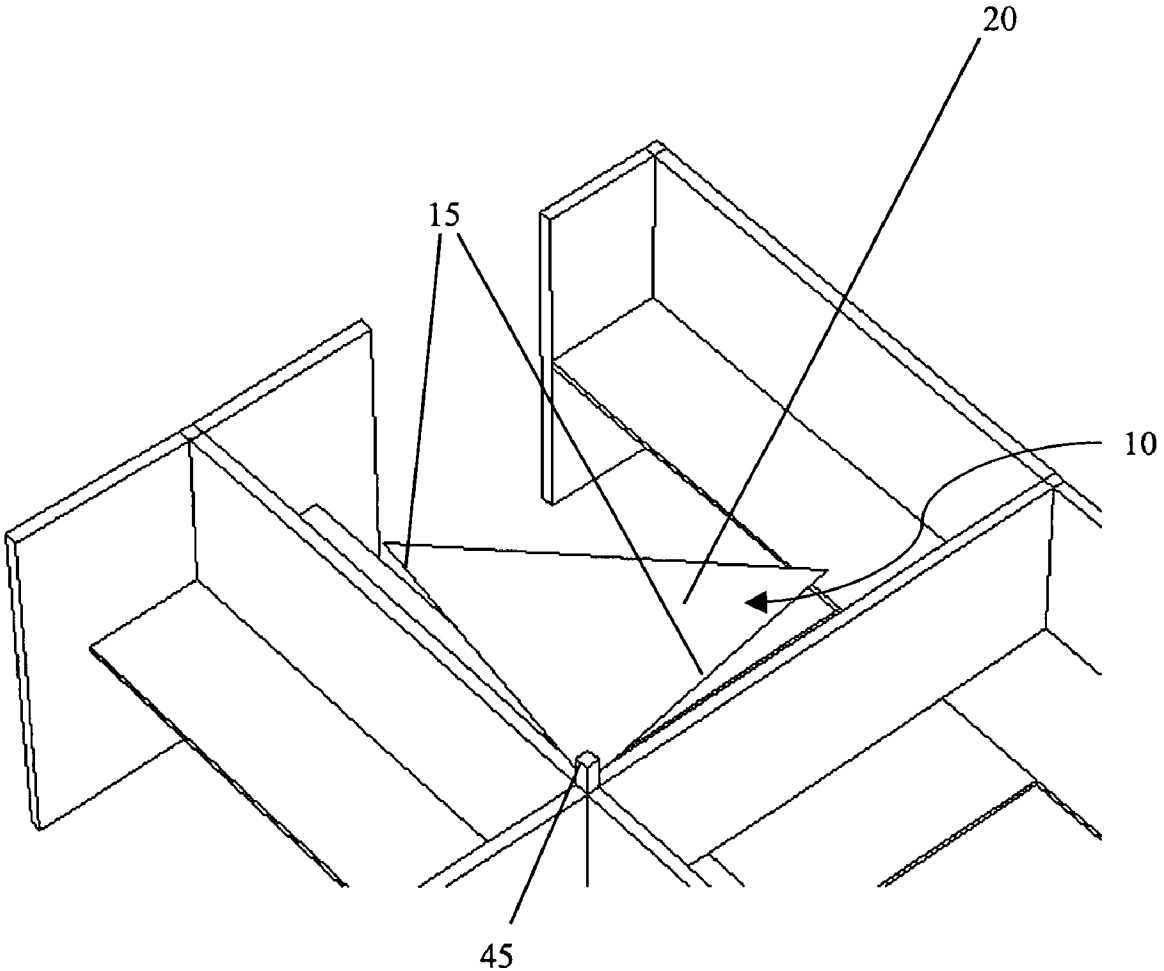
FIG. 5 is a top view of another alternative embodiment of the present invention.
Figure 6:
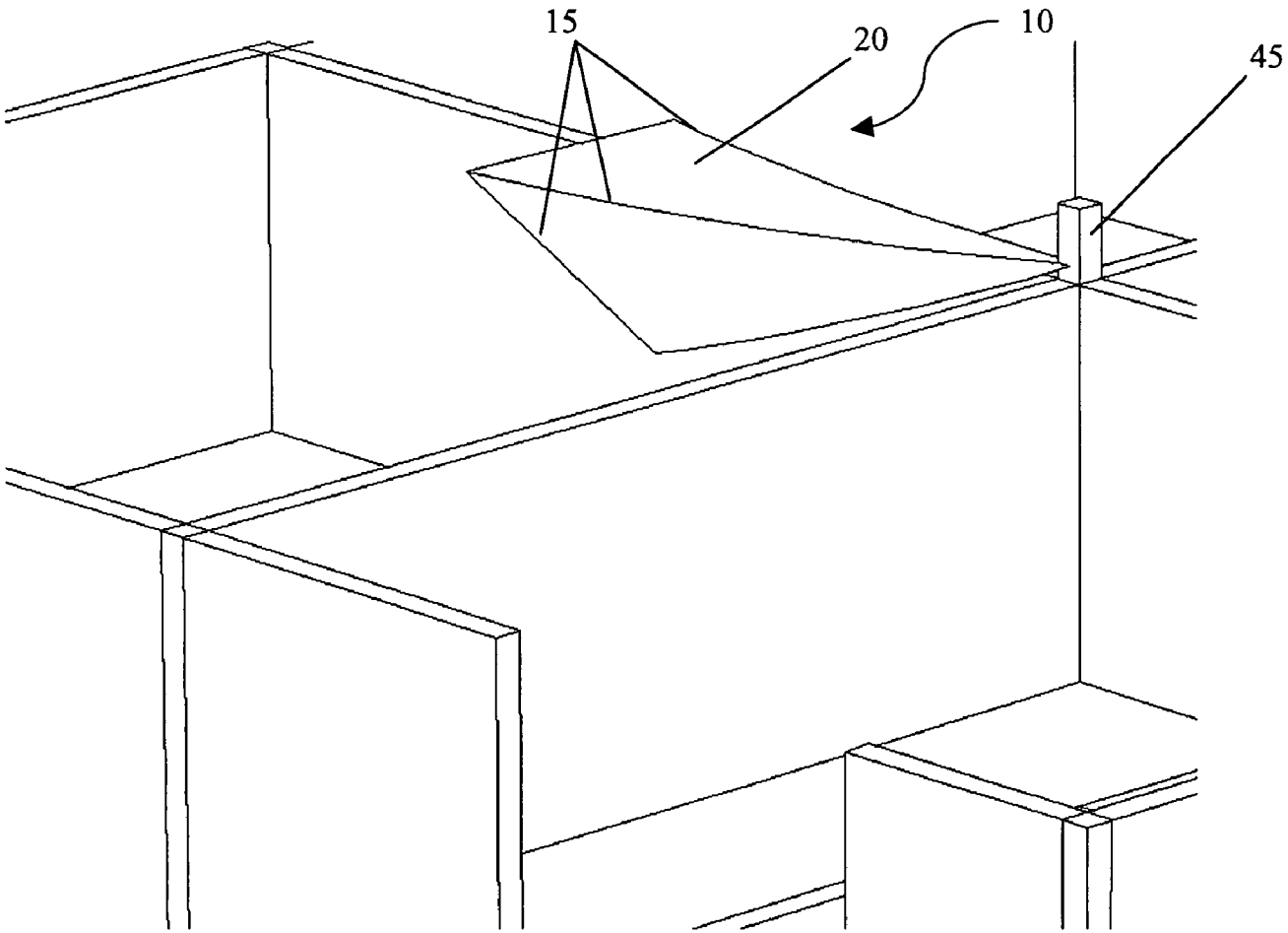
FIG. 6 is a perspective view of yet another alternative embodiment of the present invention.
Figure 7:
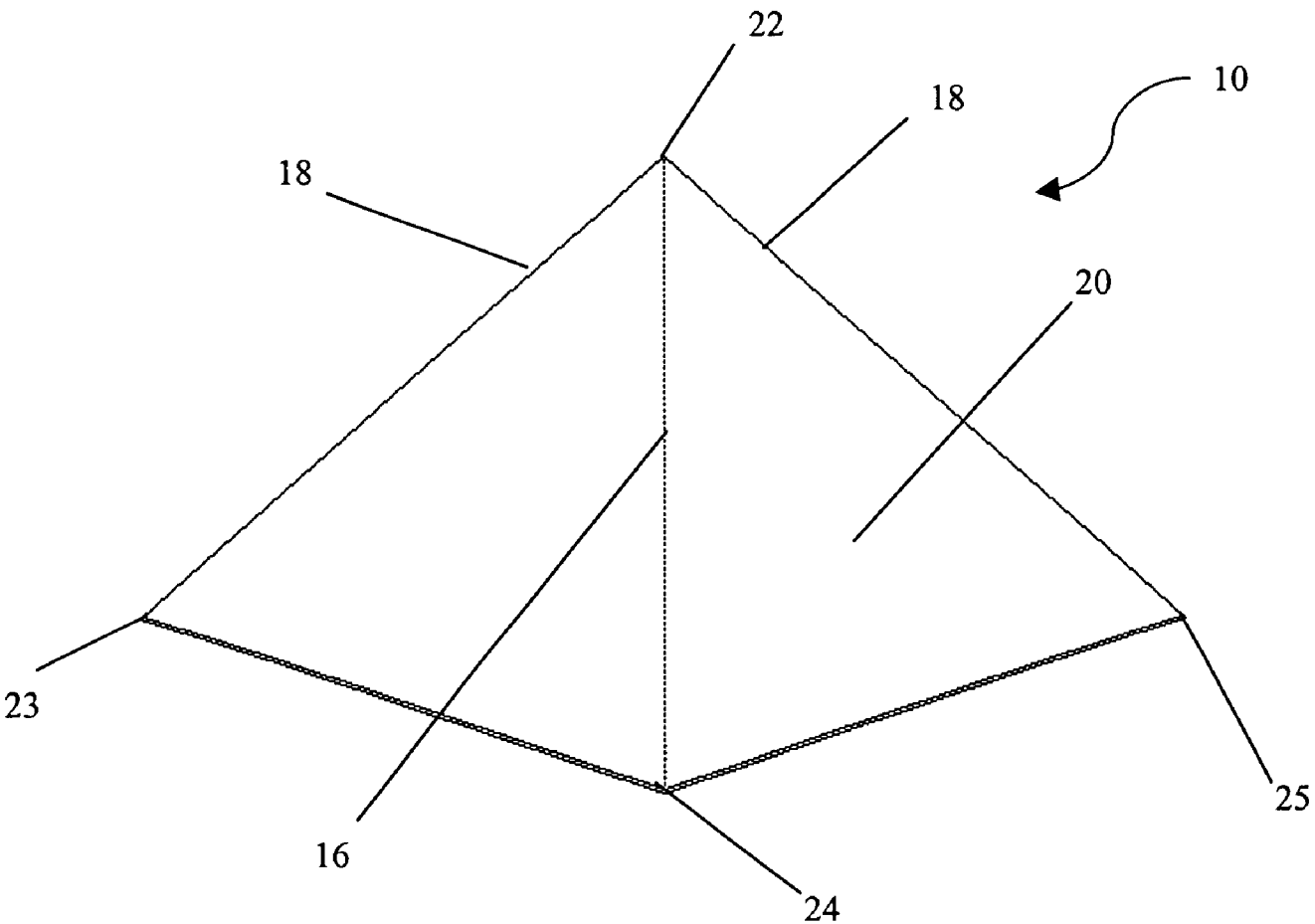
FIG. 7 is an uninstalled, flat view of a cubicle shield constructed according to the present invention.

A framed cubicle shield embodiment according to the present invention is one in which the frame and covering are formed of at least two distinct components, as shown in FIGS. 1, 4, 5, 6 and 7. The frame component 15 supplies support to hold the at least partially flexible covering 20 in position. In the present invention, the frame may be self-supporting, or supported by a rod, wire or string that attaches to the ceiling above the cubicle. The frame is preferably constructed and positioned on a cubicle, when installed, to allow the cubicle shield to extend over at least one cubicle work space or area. At least two support members are required to form the frame in one embodiment of the present invention as illustrated in FIG. 1, where in a preferred embodiment of a framed construction of a cubicle shield according to the present invention, three support members are used. The support members are formed of rigid or semi-rigid material for providing such support. In one embodiment of the present invention, the frame has a center arm 16 and 2 side arms 18, as shown in FIG. 1, that form an open-sided tetrahedron when opened and installed onto a cubicle. An uninstalled, flat view of this embodiment is shown in FIG. 7. In this embodiment, the support members form an apex 22 and are attachable to the cubicle at apices 23, 24, and 25 in at least 3 non-rectilinear points, such that an open-sided tetrahedron is formed. Alternative shapes are also provided by the present invention, e.g., by changing the number and configuration of support members, without departing from the scope of the invention.

Figure 4:
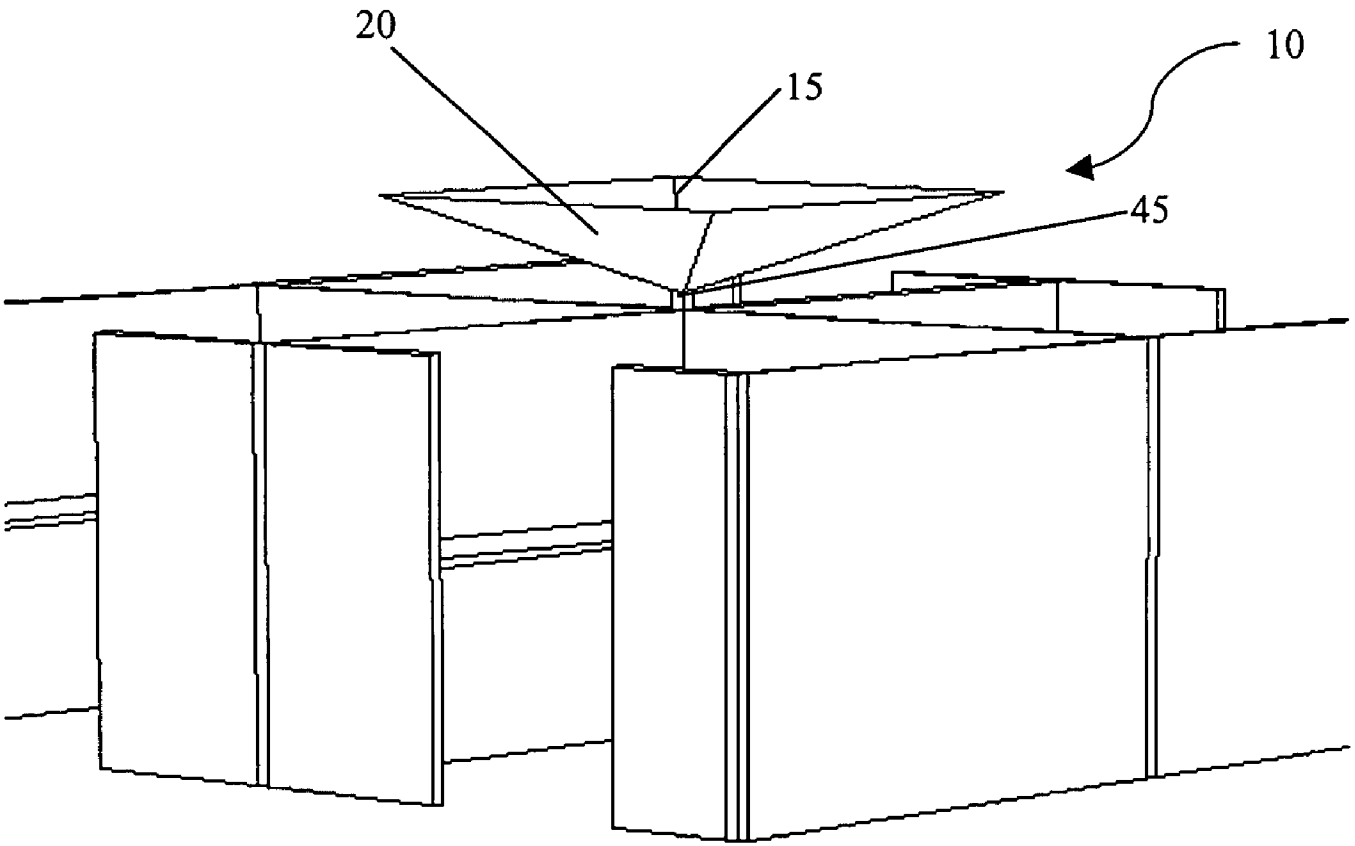
FIG. 4 is a perspective view of an alternative embodiment of the present invention.

Alternatively, in another embodiment of a cubicle shield according to the present invention, a central support extends upward from cubicle wall intersection post with support members extending over one or more cubicles conjoining at the post. In such configurations, the covering or canopy may extend over a single cubicle, or over two or more cubicles. An example of this embodiment is shown in FIG. 4, which illustrates an inverted canopy configuration, in which the covering 20 is suspended from the frame 15 mounted on a central support 45. A normal, or non-inverted canopy or umbrella configuration, in which the covering drapes downwardly over the frame, is provided in yet another alternative embodiment according to the present invention. FIGS. 5 and 6 illustrate fan configurations, in which the frame members 15 radiate out from the central support 45 extending up from a cubicle post when installed on a cubicle.

The dimensions for the frame components may vary from a minimum of 1 foot to a maximum of 10 feet, depending upon the cubicle dimensions and the amount of shading or shadowing effect that is desired for a particular cubicle. In a 3-component frame, as shown in FIG. 7, the two lateral frame components 18 are of approximately equal length, and the center frame component 16 is selectable to be approximately equal to, shorter, or longer than the lateral frame components, once again depending upon the amount of shading or shielding effect desired for a particular cubicle.

In a preferred embodiment according to the present invention, the support members are formed of at least semi-rigid material that is bendable. The support members may be segmented. The support members are removably attachable to a cubicle for providing support of the overall cubicle shield construction when it is installed on a cubicle.

The covering is formed of at least partially flexible covering material. The material is at least partially opaque to block light and provide the shading or shadowing effect described hereinabove. The covering material is preferably made of a fabric material, or a material that is assembled from components used for shades or blinds, including natural fibers or materials such as paper, cellulose, cotton, flax, rayon, bamboo, reeds, wood, and synthetic fibers, sheets, or materials, including nylon, polyester, polypropylene, PEEK, MYLAR, and the like, and may also be treated with a flame retardant or selected from a fire-resistant, flame retardant, or fire-proof material for enhanced safety. Where fabric is used, it may be woven, non-woven, or composite construction.

The cubicle shield according to the present invention is cubicle-mountable and additionally securable with fasteners, including but not limited to hook-and-loop fasteners, pins, clips, screws, adhesives, and the like. Where the shield is not self-supporting, attachment securement is preferred. Where the shield is self-supporting, such securement is desirable to further affix and confirm the position of the shield with respect to the cubicle as well as to provide safety assurances, e.g., that the shield will not fall onto a cubicle user if the cubicle is impacted and the shield is disrupted.

For an embodiment that requires securement or mounting onto a cubicle, i.e., for embodiments that are not self-supporting, the shield is preferably mounted on the side or top of the cubicle wall, or may be post-mounted. Preferably the shield is constructed of lightweight materials, such that no excessive stress is placed on the cubicle wall or post.

The present invention and various embodiments thereof thus provides a light and/or ventilation shield that also advantageously provides area for an overhead display not presently available with cubicles. Additionally, the cubicle shield can be used as a support or plane onto which art, photos, images, logos, advertisements, information, or designs are permanently or removably attached thereto or printed thereon.

Figure 8:
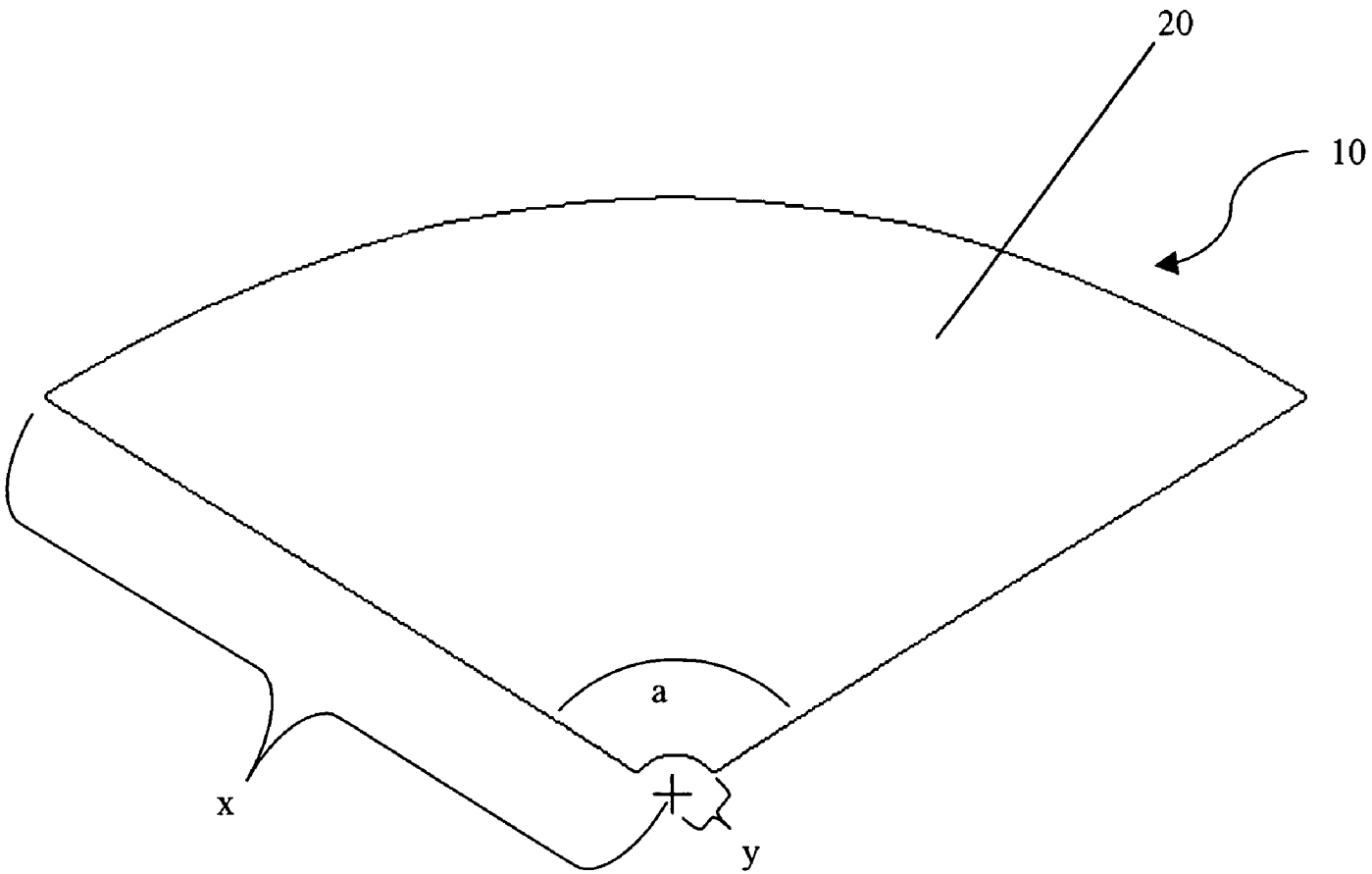
FIG. 8 is an uninstalled, flat view of a cubicle shield constructed according to the present invention.

Other embodiments of the present invention use the cubicle itself to provide the frame. Such an embodiment is a cubicle-framed, non-self-supporting cubicle shield, as shown in FIG. 2. This embodiment uses an at least semi-rigid material as an at least partially flexible covering material that spans between two cubicle walls. The cubicle walls 25 provide lateral support to maintain the covering material 20 in a non-planar, arched, 3-dimensional shape. The material is at least partially opaque, to block light. The material can be made from plastic, such as from polyethylene, polystyrene, polycarbonate, and the like, or from composite material, such as paperboard or cardboard. The covering material is of unitary, integral construction of at least one layer of material, as shown in FIG. 8. In FIG. 8, an uninstalled view of a preferred embodiment, generally shown as 80, is shown. This embodiment is a section of a circular plane with radius x=6 feet, radius y=2 to 3 inches, and arc a=135 degrees.

A variety of fasteners can be used, such as hook-and-loop, pins, screws, clips, adhesive, and the like. The covering material is side or top mountable on the cubicle wall, and the cubicle forms the supporting frame that holds the partially flexible material in the desired shape. The covering material is lightweight such as not to place undo stress on the cubicle wall or frame. The described embodiment thus provides a light and/or ventilation shield that also provides area for an overhead display.

Certain modifications and improvements will occur to those skilled in the art upon a reading of the foregoing description. By way of example, the frame can be supported by a rod, wire or string that attaches to the ceiling above the cubicle. All modifications and improvements have been deleted herein for the sake of conciseness and readability but are properly within the scope of the following claims.

The invention claimed is:

1. A cubicle shield for protecting a cubicle inhabitant from environmental parameters when placed upon a cubicle having at least two perpendicular walls each having a top edge, comprising:

a shield frame having two bottom edges and an at least partially opaque covering projecting over the cubicle such that the environmental parameters are attenuated, and wherein the two bottom edges of the shield frame for supporting the at least partially opaque covering are at least partially supported by the top edges of the perpendicular cubicle walls when placed upon the cubicle, thereby providing protection for the cubicle inhabitant against environmental parameters, and wherein the shield frame consists of two or more support members configured to form an open-sided tetrahedron when opened and installed onto a cubical.

* * * * *